US006032345A

United States Patent [19]

Resta

[11] Patent Number: 6,032,345

[45] Date of Patent: Mar. 7, 2000

[54] APPARATUS FOR FITTING QUILTING BRACES TO MATTRESSES

[75] Inventor: Roberto Resta, Faenza, Italy

[73] Assignee: Resta S.r.l., Faenza, Italy

[21] Appl. No.: 08/971,557

[22] Filed: Nov. 17, 1997

[30] Foreign Application Priority Data

Nov. 22, 1996 [IT] Italy ..... BO96A0602

[51] Int. Cl.[7] ..... B68G 7/08

[52] U.S. Cl. ..... 29/91.4; 29/91.2; 112/2.2

[58] Field of Search ..... 29/91.2, 91.3, 29/91.4; 112/2.2; 5/696

[56] References Cited

U.S. PATENT DOCUMENTS

| | | | |
|---|---|---|---|
| 776,055 | 11/1904 | Grosjean et al. | 29/91.3 |
| 1,220,237 | 3/1917 | Kenyon | 29/91.3 |
| 1,983,169 | 12/1934 | Gail | 29/91.2 |
| 2,017,100 | 10/1935 | Lang | 112/2.2 |
| 2,087,847 | 7/1937 | Morley | 112/2.2 |
| 2,089,252 | 8/1937 | Droll et al. | 112/2.2 |
| 2,192,161 | 2/1940 | Fridolph | 5/696 |
| 2,610,436 | 9/1952 | Honeycutt | 112/2.2 |
| 3,016,852 | 1/1962 | Johnson | 112/2.2 |
| 3,146,517 | 9/1964 | Skeen | 29/91.4 |

*Primary Examiner*—David P. Bryant
*Attorney, Agent, or Firm*—Guido Modiano; Albert Josif

[57] ABSTRACT

The apparatus has a structure with two frames which can move towards each other and between which the mattress is locked. The frames support a plurality of devices for applying the quilting braces. Each device comprises a needle, to which a quilting brace is coupled; the needle is driven through the mattress. On the other side of the mattress there is provided a unit which applies a tuft to the quilting brace guided by the needle. During this operation, the mattress is compressed so that once it is released it expands and tensions the applied quilting braces.

6 Claims, 7 Drawing Sheets

APPARATUS FOR FITTING QUILTING BRACES TO MATTRESSES

BACKGROUND OF THE INVENTION

The present invention relates to an apparatus for fitting quilting braces to mattresses.

Mattresses, in order to avoid retaining the external padding and an excessive swelling caused by compression of the internal springs or of the filling material (wool or horsehair), are kept flat by a plurality of quilting braces which are known in the jargon as tufts, stitches or pompons. These devices are tufts of woolly material arranged on the opposite faces of the mattress and mutually connected by a tie element (cord or tape) which is driven through the mattress. In practice, the tufts act as coupling points for the cords or tapes when they are tensioned.

Quilting braces are currently applied with mostly manual methods and therefore with excessively long times and at high cost.

SUMMARY OF THE INVENTION

The aim of the present invention is therefore to provide an apparatus which is capable of automating the application of quilting braces to mattresses, thus obviating the drawbacks of conventional systems.

Within the scope of this aim, an object of the present invention is to provide an apparatus which is versatile in operation in relation to the possibility of varying the location of the quilting braces as required.

This aim and this object are achieved with an apparatus for applying quilting braces to a mattress, said quilting braces being composed of a tie element, a first tuft being fastened to one end of said tie element, said tie element having, at its opposite end, a toggle or head which is adapted to be driven through a hole of a second tuft in order to engage said second tuft after the tie element has been driven through the mattress, characterized in that it comprises: a structure for locking a mattress; a plurality of devices for applying a quilting brace which can be positioned on said structure at the points of application of said quilting braces, each device being composed of a first unit and a second unit; said first unit being installed on one side of said mattress and comprising a needle which can move at right angles to said mattress and is provided, proximate to its tip, with a seat which is adapted to detachably retain inside it said toggle manually inserted by an operator, said needle having such a diameter that it passes through said hole; an actuator for pushing said needle through said mattress until said seat protrudes from the side opposite to the one wherein said needle was driven and said first tuft of the quilting brace, pulled by said needle, abuts against the mattress and causes a partial compression thereof; said second unit being installed on the opposite side of said mattress with respect to the side of said first unit and comprising a rod which is guided coaxially to said needle on the side opposite to the insertion side of said needle and has an end which is directed towards said mattress; means for retaining a plurality of tufts, meant to constitute the second tuft of each quilting brace and superimposed on said rod; pusher means which are adapted to push said tufts towards said retention means so as to form a stack of tufts; elastic means, which are adapted to actuate said rod against said retention means, whereat the front tuft of said stack is at the end of said rod; a separator, which is actuated by an actuator between a position for separating said front tuft from the directly adjacent one and a position for disengaging from said tufts, said actuators of the needle and of the separator being actuated so that during a first step said separator is kept in the position for separating said front tuft from the remaining tufts of the stack whilst said needle, after passing through said mattress, engages the end of said rod and causes the simultaneous spacing of said stack from said front tuft and the transfer of said front tuft from said rod onto said needle and therefore the release of said toggle from said needle when the expansion force applied by the compressed mattress exceeds the force that keeps the toggle in its seat in the needle, so that said toggle can pull said separated front tuft against said mattress; and so that during a second step, said separator is actuated into the disengagement position and said needle is returned to the initial position, whilst said stack of tufts is pushed by said pusher means against said retention means.

BRIEF DESCRIPTION OF THE DRAWINGS

Further characteristics and advantages of the present invention will become apparent from the following detailed description of a preferred embodiment, illustrated by way of non-limitative example in the accompanying drawings, wherein.

DESCRIPTION OF THE PREFERRED EMBODIMENTS

Figure 1:
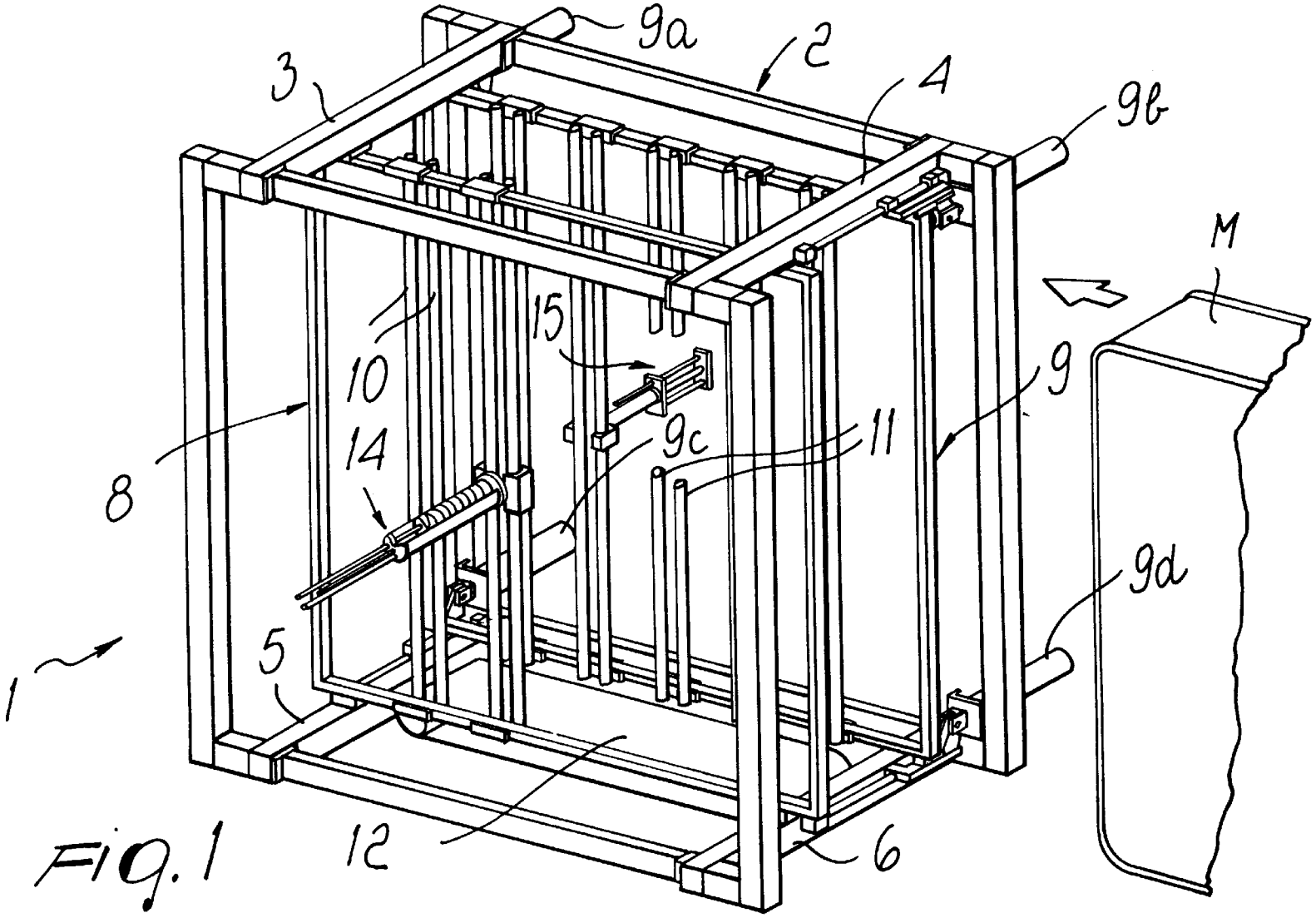
FIG. 1 is a perspective view of the apparatus.

With reference to the figures, the apparatus comprises a structure composed of two rectangular frameworks 1 and 2 which are connected by cross-members 3, 4, 5, 6 so that one is flat and parallel with respect to the other.

The cross-members 3 to 6 vertically support two rectangular, flat and parallel frames 8 and 9; a plurality of mutually parallel posts 10 and 11 lies between the upper and lower stringers of said frames and give said frames the appearance of grilles. The frame 8 is fixed to the cross-members 3–6, whilst the frame 9 is guided on said cross-members and can move with respect to the frame 8 by means of pneumatic jacks 9*a*, 9*b*, 9*c* and 9*d* whose cylinders are coupled by flanges at the corners of the frame 2 and whose stems are rigidly coupled to the frame 9.

The posts 10 and 11 form pairs of guides; each guide associated with the frame 8 is arranged opposite to a corresponding pair of guides of the frame 9. The posts 10 and 11 are constituted by bars having a quadrangular cross-section (see FIG. 3) and are arranged so that their faces are oblique with respect to the plane of the frames 8 and 9.

The frame 9, by means of the jacks 9*a*–9*d*, can move between a position for spacing from the frame 8, which allows to insert a mattress M between said frames, and a mutually adjacent position, at which the mattress remains locked between the frames 8 and 9. Below the frames 8 and 9 there is provided a conveyor 12 which is closed in a loop around guiding pulleys and places the mattress M between the frames 8 and 9.

A plurality of devices 13 (see FIG. 2) for applying the quilting braces through the mattress are installed on the various pairs of posts 10 and 11.

Each device 13 is composed of a first unit 14, which can be positioned on a pair of posts 10 of the frame 8, and a second element 15, which can be positioned on the pair of posts 11 of the frame 9.

The unit 14 is composed of a bracket 16, on the arms of which two respective blocks 17 and 18 are internally fixed; said blocks have vertical and mutually opposite grooves 19. Two respective jaws 20 and 21 are arranged between the blocks 17 and 18 and are provided with grooves 23 which lie opposite to the grooves 19. Each one of the grooves 19 and 23 is formed by two perpendicular faces in order to couple perfectly to the faces of the posts 11.

The jaws 20 and 21 can be moved adjacent to, or spaced from, the blocks 17 and 18 by means of wing nuts 24 and 25, so as to form clamps for fixing the units 14 to the posts 10 of the frame 8.

A pneumatic cylinder 26 is rigidly coupled to the bracket 16; its stem 27 lies at right angles to the frame 8, on the side opposite to the one where the bracket 16 is coupled to the posts 10.

A plate 28 is fixed to the end of the stem 27, and two respective rods 29 and 30 are rigidly coupled to said plate; said rods are parallel to the stem 27 and can slide in a flange 31 of the cylinder 26. A needle 32 is coaxially rigidly coupled to the rod 30, protrudes outside the cylinder and is provided with means for coupling a quilting brace P to be applied transversely to the mattress.

Figures 5, 9:
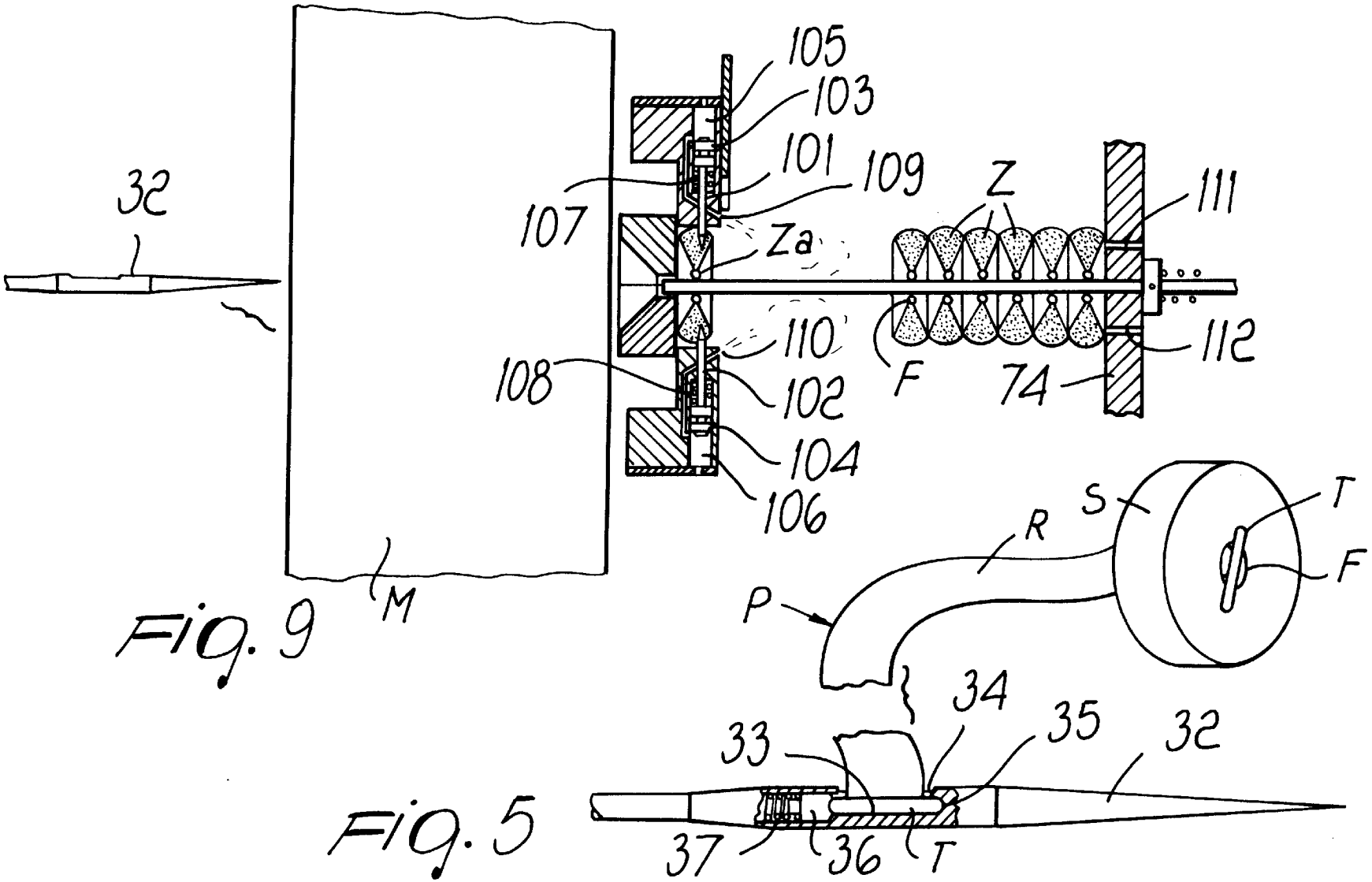
FIG. 5 is a partially sectional view of the tip of the needle of the device.
FIG. 9 is a view of a different embodiment of the apparatus.

As shown more clearly in FIG. 5, the quilting brace P is composed of a tie element R, which in this case is constituted by a tape at one end of which two toggles T are fixed in order to retain two tufts S and Z (in FIG. 5, the tuft Z has not been applied yet). The toggles T are constituted in practice by a cylindrical pin whose ends are hemispherical and whose diameter is such that it can pass through the central hole F of the tufts S and Z and remain coupled thereto in order to complete the quilting brace P. The tufts S and Z are constituted in practice by disks made of woolly material, at the center of which an eyelet for the passage of the toggles is fixed, forming the hole F. The tuft S can also be permanently fixed to the end of the tie element R.

The means provided on the needle to fasten the quilting brace to be applied to the mattress comprise a seat 33 which is formed proximate to the tip of the needle 32 and can be accessed through a slot 34 whose breadth allows to insert the toggle T in the seat 33. The seat 33 continues towards the tip of the needle 32 with a recess 35 and, on the opposite side, with a seat in which a pin 36 can slide; said pin is actuated by a spring 37 towards the recess 35, so that by inserting the toggle in the seat 33 said toggle is retained inside the seat 33, between the pin 36 and the recess 35. The force of the spring 37 is set so as to allow the needle 32 to pass through the mattress M without disengaging the toggle T from the seat 33.

The diameter of the needle 32 is such that it can pass through the central hole of the second tuft Z, which is fed by the second unit 15.

Figure 2:
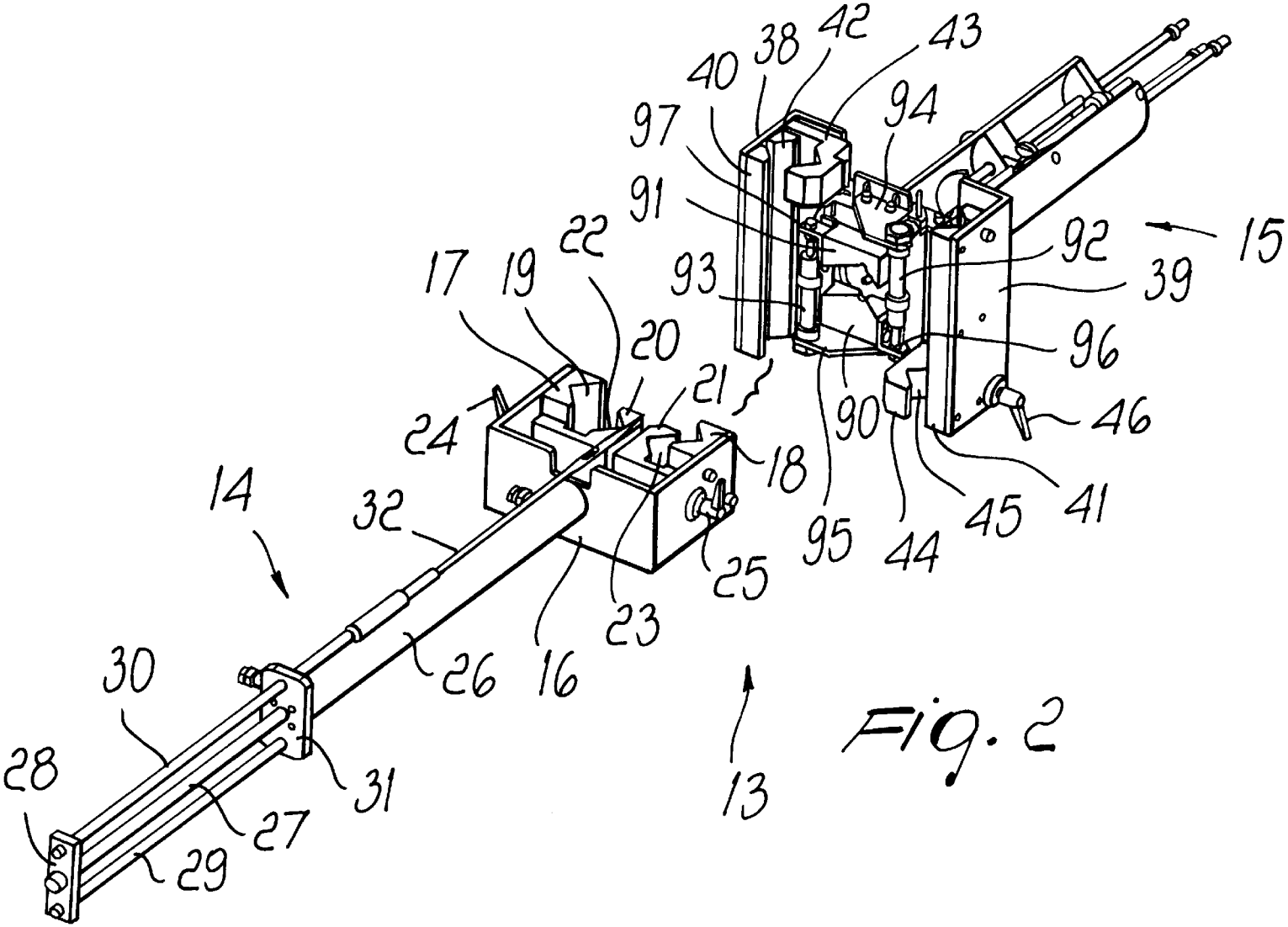
FIG. 2 is a perspective view of a device for applying a quilting brace.
Figure 3:
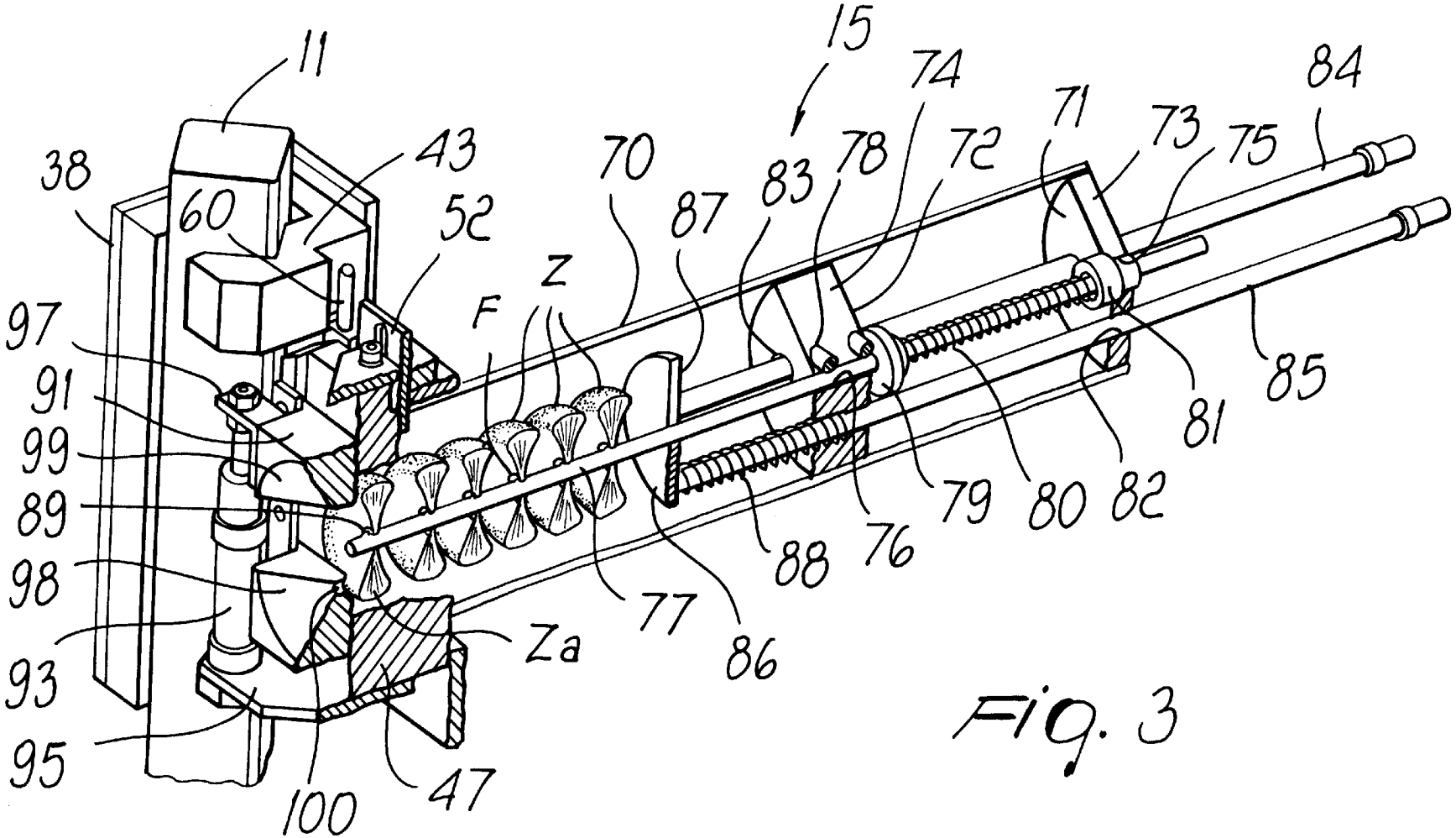
FIG. 3 is a partially sectional perspective view of a part of the device shown in FIG. 2.

As shown more clearly by FIGS. 2 and 3, said element 15 comprises a bracket which is formed by two arms 38 and 39 which support two clamps fully identical to those described earlier with regard to the reference numerals 17 to 25. Said clamps are in fact composed of two blocks 40 and 41 provided with mutually opposite V-shaped grooves 42.

Two respective jaws 43 and 44 are provided in opposition to each block 40 and 41; each jaw also has V-shaped grooves 45 which are arranged opposite the grooves 42 of the blocks 40 and 41. The grooves 42, 45 are formed by two mutually perpendicular faces in order to perfectly couple to the faces of the posts 11.

Wing nuts 46 are screwed into the jaws 43 and 44; their actuation allows to move the jaws 43, 44 mutually closer or further apart with respect to the respective blocks 40 and 41, thus forming two clamps by means of which the unit 15 can be applied to a pair of posts 11.

Figure 4:
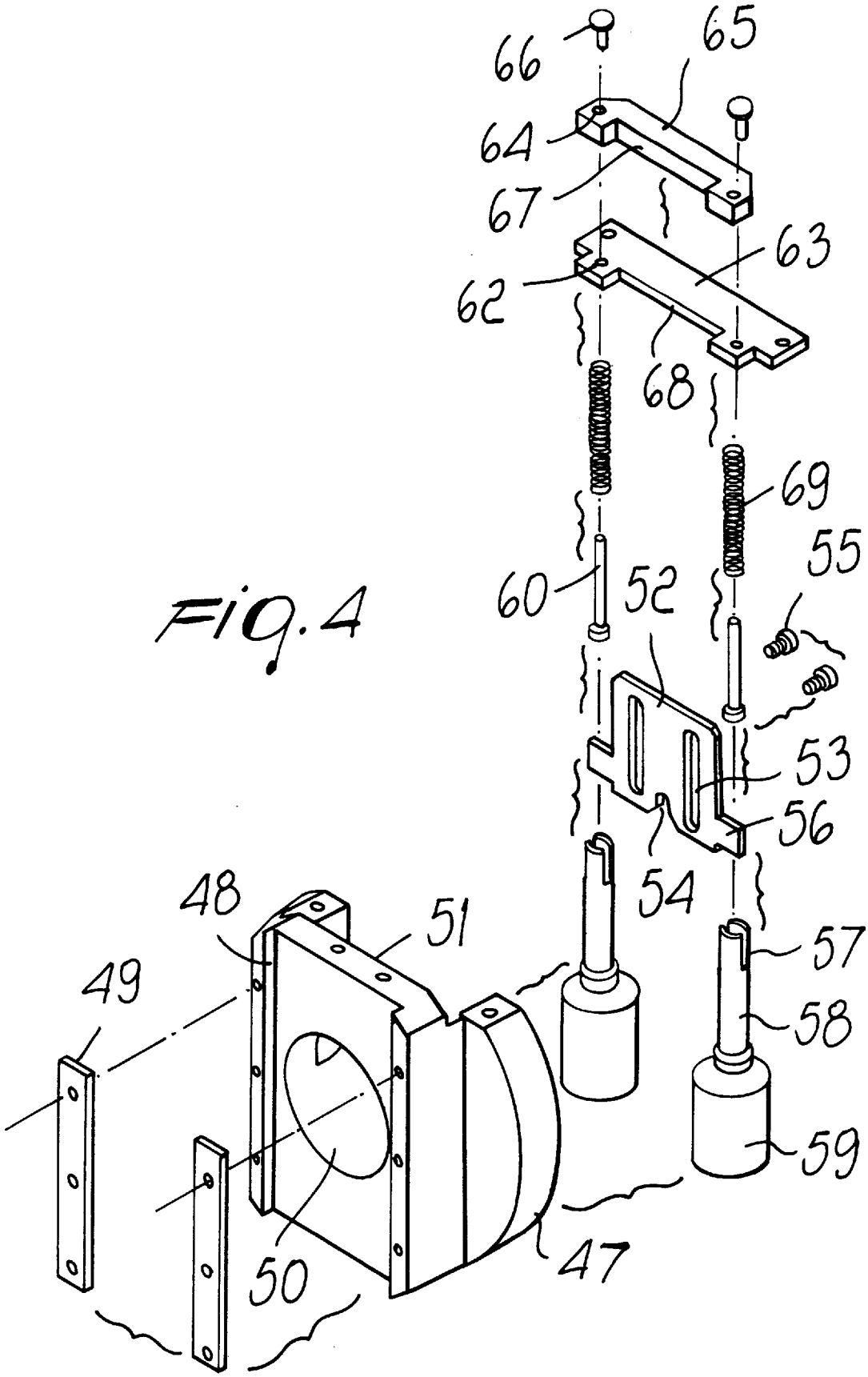
FIG. 4 is a perspective view of a constructive detail.

The arms 40 and 41 are firmly joined together by a plate 47, shown more clearly in FIG. 4. Said plate is provided, on its front face, with a guide 48 formed by two strips 49 and is centrally provided with a circular opening 50 whose diameter is complementary to the diameter of the tuft Z.

A secondary plate 52 rests on the rear face 51 of the plate 47 and is termed separator plate owing to its function, which is described hereinafter. Two parallel slots 53 are formed in the secondary plate 52, and on its lower edge there is provided a semicircular notch 54 which is located on the centerline of said secondary plate, between the slots 53.

Two screws 55 are slidingly driven through the slots 53 and are screwed into the face 51; said screws keep the secondary plate 52 in sliding contact on the face 51. The plate 52 has two lateral expansions 56 which are inserted in diametrical slits 57 formed at the upper ends of tubular stems 58 of two pneumatic jacks 59. Two respective auxiliary rods 60 rest on the expansions 56 and have a lower head which is guided in the tubular stems 57 and acts on the expansions 56. The auxiliary rods 60 are slidingly inserted in holes 62 of a strip 63 and in holes 64 of a bridge 65; said strip and said bridge are fixed to the plate 47 so as to cantilever out from the face 51 by means of screws 66.

The bridge 65 and the strip 63 have notches 67 and 68 through which the secondary plate 52 is passed.

Respective springs 69 are guided on the auxiliary rods 60 and rest, in an upward region, against the strip 63 and, in a downward region, on the heads of the secondary rods 60, so as to keep the expansions 56 of the plate 52 engaged in the slits 57 of the ends of the stems 58.

A half tube 70 for containing the tufts Z is fixed in a cantilevered fashion to the plate 47 on the side of the face 51; said half tube is open upward and is coaxial to the opening 50. Two elements 71, 72 are fixed at the end and in an intermediate position of the half tube 70 and have a disk-like shape that couples to the half tube 70. The elements 71 and 72 are chamfered in an upward region so as to form two inclined planes 73 and 74 which converge towards respective central holes 75 and 76 which are open upward.

A tubular rod 77 for supporting the tufts Z is guided in the hole 76 and is retained in said hole 76 by a fork provided with two prongs 78 which can be inserted in the element 72 at right angles to the rod 77. The fork 78 can be extracted from the element 74 when the rod 77 is to be replaced with a full one, particularly to remove a rod which has already been emptied of the tufts Z.

A ring 79 is axially rigidly coupled to the rod 77 and acts as abutment for a spring 80 which lies on the portion of the rod 77 arranged between the disk-like elements 71 and 72. The spring, on the opposite side with respect to the ring 79, abuts against a bush 81 which is accommodated in the hole 75 and through which the rod 77 passes slidingly.

Respective pairs of guiding holes 82, 83 are also formed in the elements 71 and 72, below the central hole 75 and 76, for a pair of parallel rods 84 and 85 which protrude towards the plate 47. A pusher 86 is fixed to the ends of the rods 84 and 85 which lie between the element 72 and the plate 47 and is constituted by a disk wherein there is provided a radial slit 87 wider than the diameter of the rod 77.

Springs 88 are arranged on the portions of the rods 84, 85 that lie between the element 72 and the disk 86 and move the plate 86 towards the plate 47 in order to push forward a plurality of tufts Z arranged on the rod 77 so as to form a stack.

The tufts Z on the rod 77 are retained axially by an elastic retainer 89, which is constituted by a highly elastic wire folded so as to form an arc which is accommodated in a recess of the rod. The retainer 89 protrudes from the surface of the rod and can retract into it when it is pushed radially in order to allow the passage of the tufts.

The ring 79 retains the rod 77 in the position wherein the front tuft $Z_a$ of the stack, which abuts against the retainer 89 owing to the thrust applied by the pusher 86, is inserted in the opening 50.

Two sliding blocks 90, 91 can slide in the guide 48 of the plate 47 and can be moved mutually closer or further apart by means of respective pneumatic jacks 92 and 93. The jacks 92 and 93 are fixed to brackets 94, 95 (see also FIG. 2) which protrude from the plate 47 and the stems of which are connected to L-shaped elements 96, 97 which are fitted laterally with respect to the respective sliding blocks 90, 91.

The sliding blocks 90, 91 have, on the face directed towards the mattress M, respective conical cavities 98, 99 which, in the position wherein the sliding blocks are mutually adjacent, form a sort of funnel which converges towards a central hole 100 formed by complementary notches provided in the surfaces of the sliding blocks that make mutual contact. When the sliding blocks are in the mutual contact position, the central hole 100 is aligned with the needle 32 in order to guide it against the front end of the rod 77.

The operation of the described apparatus is as follows.

First of all, the devices 13 are arranged according to the intended layout of the quilting braces P on the mattress M. For this purpose, the units 14 and 15, by means of the clamps 17–25 and 40–46, are placed along the posts 10 and 11, taking care to align each needle 32 with a respective tubular rod 77.

Once this preparatory step has ended, the mattress M is inserted between the frames 8 and 9 and is locked by means of the jacks 9*a*–9*d*.

Figure 6:
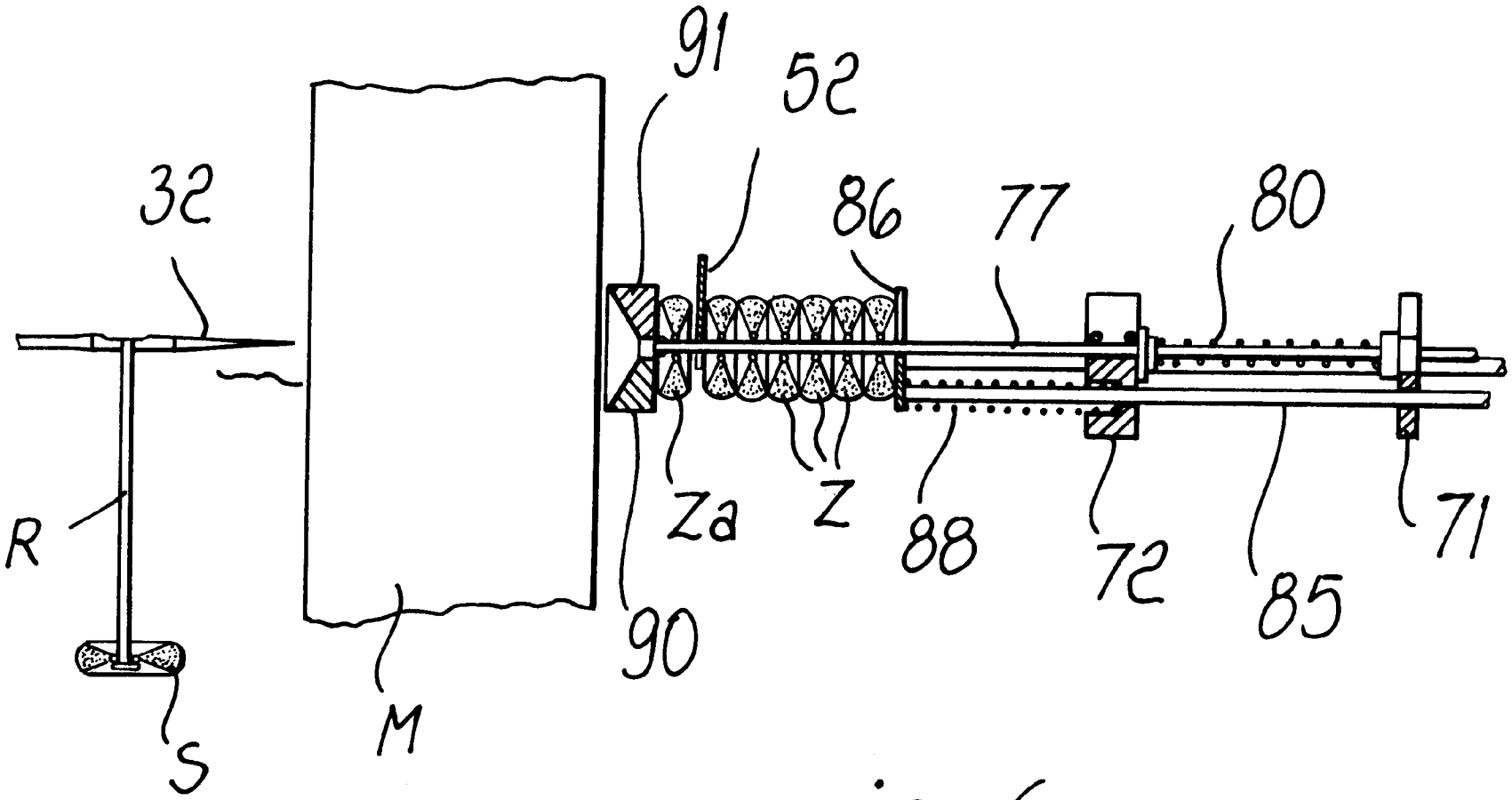
FIGS. 6, 7 and 8 are views of three successive operating positions of the device during the application of a quilting brace to a mattress; and finally

The operating steps of each device 13 include the mutually adjacent arrangement of the sliding blocks 90, 91 by means of the actuation of the jacks 92 and 93 and the descent of the separator plate 52 caused by the thrust of the springs 69 and the lowering of the stems 58 of the jacks 57. In this situation, shown in FIG. 6, the front tuft $Z_a$ of the stack of tufts Z superimposed on the rod 77 is inside the opening 50 of the plate 47, interposed between the sliding blocks 90, 91 and the secondary plate 52.

The jack 26 is then actuated and pushes the needle 32 through the mattress M; the tie element R, provided with the tuft S by inserting the toggle T in the seat 33, has been applied beforehand to said needle 32.

When the needle 32 has passed through the mattress, it is guided by the funnel 98, 99 of the sliding blocks 90, 91 into the hole 100 and then engages the end of the rod 77. As the stroke of the pneumatic jack 26 continues, the rod 77 is pushed backward in contrast with the elastic reaction of the spring 80. When the thrust applied by the needle 32 to the rod 77 is such that the spring 89 is forced to retract into the rod 77, the front tuft $Z_a$ separates from the rod and remains inserted on the tip of the needle 32 (FIG. 7).

As the advancement stroke of the needle continues, the rod 77 is kept rested against the tip of the needle by means of the thrust of the spring 80, whilst the pusher 86, by means of the action of the springs 88, returns the tufts Z of the stack that follow the tuft $Z_a$ into abutment against the retainer 89. The elastic thrust applied by the springs 88 is of course very weak, in order to prevent the tufts Z of the stack from moving beyond the elastic retainer 89.

Figure 7:
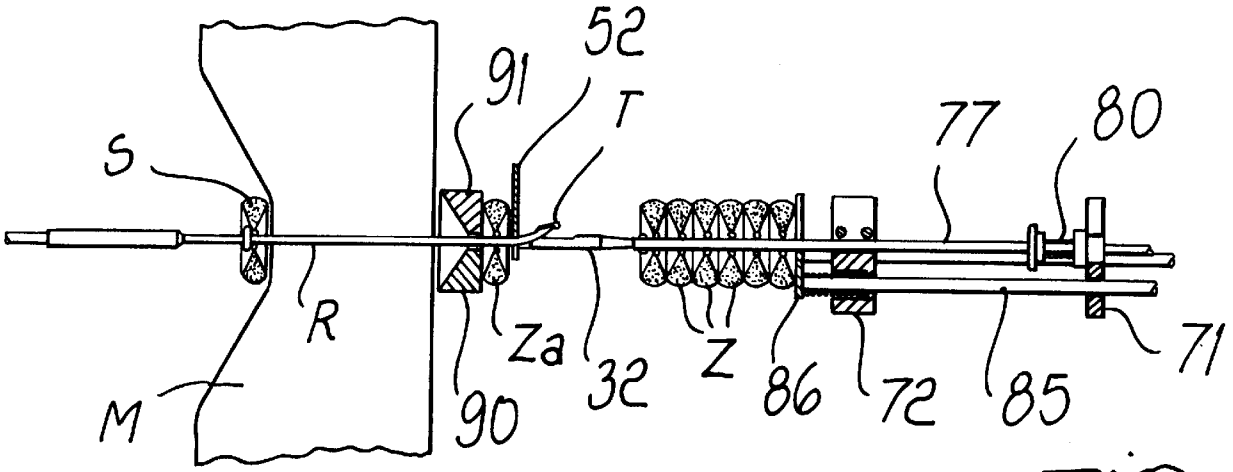

As the needle 32 advances, the mattress M is gradually compressed and therefore the traction applied by the tape R to the toggle T in the seat 33, and thus on the pin 36, increases; by retracting in contrast with the thrust of the springs 37, said pin, once the return force of the spring 37 has been exceeded, disengages from the seat 33 (FIG. 7). Since the mattress M is no longer retained under compression by the traction element R, it can expand and pull the toggle T against the tuft $Z_a$.

Figure 8:
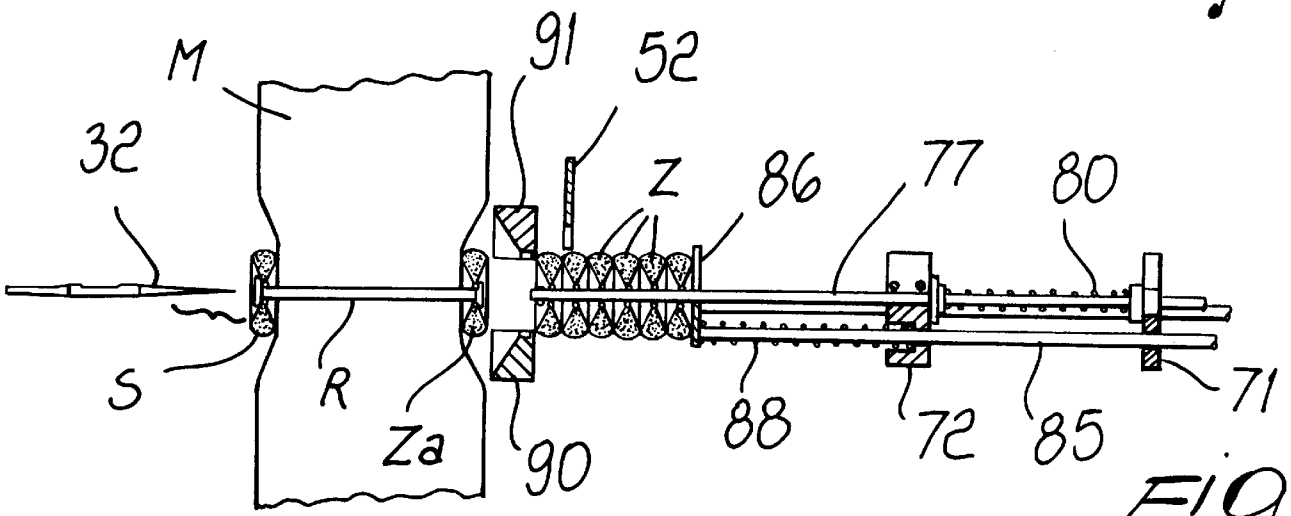

At this point the sliding blocks 90, 91 are opened, allowing the tuft $Z_a$ to rest against the mattress. At the same time, the jacks 59 and the jack 26 are actuated and lift the secondary plate 52 into a position for disengaging from the tufts and respectively extract the needle from the mattress M (FIG. 8). Finally, the springs 80 and 88 return the stack of tufts Z to the initial position, wherein the secondary plate 52 is moved downward again in order to separate a new front tuft. The apparatus is thus in the condition shown in FIG. 6 and the operating cycle can be repeated in the above-described manner.

It is evident that the described invention perfectly achieves the intended aim and objects. In particular, the apparatus has proved itself highly versatile in relation to the possibility of positioning the quilting brace application devices in a preset pattern by moving the units 14 and 15 along the posts 10 and 11.

One advantage of the invention is the fact that the rod can be removed from its seat after extracting the fork 78 to replace it with another one, already loaded with a new series of tufts Z.

The described apparatus is susceptible of numerous modifications and variations, all of which are within the scope of the same inventive concept.

FIG. 9 illustrates a solution in which instead of the elastic retainer 89 at the end of the rod 77 there are provided two needles 101, 102 which are guided diametrically in the plate 47 and protrude into the opening 50. The needles 101, 102 are connected to respective pistons 103, 104 which can slide in cylinders 105, 106 formed in the plate 47.

The cylinders 105, 106 are connected to a compressed air source which moves the needles 101, 102 towards the hole 50 in contrast with the return action of elastic means 107, 108 interposed between the pistons 103, 104 and the bottom of the cylinders 105, 106.

Ducts 109, 110 extend from the cylinders 105, 106, lead onto the rear face 51 of the plate 47 and are orientated so that the air jets converge towards the rod 77.

Additional holes 111, 112 are formed in the supporting element 74 of the rod 77 and are orientated axially towards the plate 47.

During the advancement of the needle 32, the needles 101, 102 retain the front tuft Z, whilst the compressed air that flows out of the holes 109, 110 pushes back the stack of tufts Z, allowing the toggle T to engage only the front tuft $Z_a$. As soon as the toggle has engaged the front tuft $Z_a$, the needles 101, 102 are retracted and the sliding blocks 90, 91 are opened to allow the released tuft to rest against the mattress. Compressed air is then sent through the holes 111, 112 so as to push the stack of tufts Z towards the plate 47 and allow the needles 101, 102 to retain a new front tuft.

What is claimed is:

1. An apparatus for applying quilting braces at points of application located on opposite sides of a mattress, said quilting braces being composed of a tie element, a first tuft being fastened to one end of said tie element, said tie element having, at its opposite end, a toggle which is adapted to be driven through a hole of a second tuft for engaging said second tuft after the tie element has been driven through the mattress, comprising: a locking structure for locking a mattress; a plurality of devices for applying a quilting brace, which are positionable on said structure at the points of application of said quilting braces, each said device being composed of a first unit and a second unit; said first unit being installed on one side of said mattress and comprising a needle which is movable at right angles to said mattress and is provided, proximate to its tip, with a seat for detachably retaining therein said toggle, manually inserted, said needle having such a diameter so as to pass through said hole; an actuator for pushing said needle through said mattress until said seat protrudes from a mattress side opposite to the side in which said needle was driven and said first tuft of the quilting brace, pulled by said needle, abuts against the mattress for causing a partial compression thereof; said second unit being installed on the opposite side of said mattress with respect to the side of said first unit and comprising a rod which is guided coaxially to said needle on the side opposite to the insertion side of said needle and has an end which is directed towards said mattress; retaining means for retaining a plurality of tufts, for constituting each a said second tuft of each quilting brace and superimposed on said rod; pusher means for pushing said tufts towards said retention means so as to form a stack of tufts; elastic means, for actuating said rod against said retention means, at which the front tuft of said stack is located at an end of said rod; a separator, which is actuated by an actuator thereof between a position for separating said front tuft from a directly adjacent one and a position for disengaging from said tufts, said actuators of the needle and of the separator being actuated so that said separator is kept in the position for separating said front tuft from the remaining tufts of the stack while said needle, after passing through said mattress, engages the end of said rod for causing simultaneous spacing of said stack from said front tuft and the transfer of said front tuft from said rod onto said needle and therefore release of said toggle from said needle when an expansion force applied by the compressed mattress exceeds the force that keeps the toggle in its seat in the needle, so that said toggle can pull said separated front tuft against said mattress; and so that said separator is further actuated into a disengagement position and said needle is returned to the initial position, while said stack of tufts is pushed by said pusher means against said retention means.

2. The apparatus according to claim 1, wherein said second unit comprises a plate having coupling elements for coupling to said structure, supporting elements for slidingly supporting said rod on said plate in contrast with said elastic means, and wherein said retention means comprise: two sliding blocks which are guided on said plate at right angles to said rod; actuator means for moving said sliding blocks mutually closer and further apart, said sliding blocks having respective concave regions which, in their mutually adjacent position, form a funnel for guiding said needle so as to abut against said rod axially.

3. The apparatus according to claim 2, wherein said separator is constituted by a secondary plate which is slidingly supported on said plate, said secondary plate being actuated by an actuator thereof between a position for engagement between said front tuft and a directly adjacent one.

4. The apparatus according to claim 3, wherein said separator comprises: needle means which are actuated by an actuator thereof between a position for retaining the front tuft and a position for releasing it; compressed air jet means for separating the tufts of said stack from said front tuft when said front tuft is retained by said needle means so as to allow only said front tuft to pass on said needle; compressed air jet means being provided for returning said stack of tufts against said stop means when said toggle has disengaged from said needle and said front tuft has been pulled against said mattress.

5. The apparatus according claim 1, wherein said structure for locking the mattress comprises two frames which are movable with respect to each other for locking a mattress inserted between them, said frames having posts along which said units for applying the quilting braces are positionable.

6. The apparatus according to claim 5, wherein said units are provided with clamps, said clamps being tightened onto said posts.

* * * * *